United States Patent [19]

Graf

[11] Patent Number: 4,590,645

[45] Date of Patent: May 27, 1986

[54] CARD CLOTHING FOR CARDING MACHINES

[75] Inventor: Ralph Graf, Freienbach, Switzerland

[73] Assignee: Graf & Cie AG, Rapperswil, Switzerland

[21] Appl. No.: 645,502

[22] Filed: Aug. 29, 1984

[30] Foreign Application Priority Data

Sep. 29, 1983 [CH] Switzerland ..... 5285/83

[51] Int. Cl.[4] ..... D01G 15/84

[52] U.S. Cl. ..... 19/114

[58] Field of Search ..... 19/114

[56] References Cited

U.S. PATENT DOCUMENTS 4,357,738 11/1982 Siegrist ..... 19/114

FOREIGN PATENT DOCUMENTS 0041076 12/1981 European Pat. Off. ..... 19/114
442972 12/1924 Fed. Rep. of Germany ..... 19/114
66026 2/1927 Sweden ..... 19/114

*Primary Examiner*—Louis K. Rimrodt
*Assistant Examiner*—J. L. Olds
*Attorney, Agent, or Firm*—Ladas & Parry

[57] ABSTRACT

Rows of teeth which seen in direction of fiber flow trail preceding rows of teeth are laterally displaced relative thereto. The measure of displacement decreases when viewed in direction of fiber flow such that the width of the lanes also decrease in the direction of fiber flow. Accordingly, only coarser contaminants will be removed at the leading inflow area of the flat and finer contaminants will be removed in trailing flat areas. Additionally, an improved parallelizing of the fibers being carded is achieved.

9 Claims, 8 Drawing Figures

CARD CLOTHING FOR CARDING MACHINES

BACKGROUND OF THE INVENTION

1. FIELD OF THE INVENTION

The present invention relates to an improved card clothing for carding machines, including a plurality of card wire teeth arranged in rows and set into a card fillet, which wire teeth are shaped to have a base section, a first point including a first tip and projecting from one end of the base section, and a second point including a second tip projecting from the opposite end of the base section.

2. DESCRIPTION OF THE PRIOR ART

The German industrial standards define in the standards sheet DIN 64 108 the terms and the secondary terms of card fillets, which disclose specifically the various methods of setting the wires. For card clothing which finds application on textile carding machines a preferred pattern is the so-called diagonal stitch wire setting of the card clothing. This diagonal stitch is defined and explained on page 2, cipher 2.2. of mentioned DIN 64 108. The diagonal stitch is mainly set as 4-diagonal stitch or 6-diagonal stitch. In case of a 4-diagonal stitch a respective second row of teeth is laterally offset or displaced, respectively, regarding the first row of teeth by ½ width of the teeth (l/2). This displacement corresponds to the width of lane $g_1$. In case of a 6-diagonal stitch a second row of teeth is displaced relative to a respective first row of teeth by ⅓ width of lane (l/2). A combination of diagonal stitches, i.e. an alternating use of a 4-diagonal stitch and 6-diagonal stitch is, for instance, used, too.

These stitch patterns incorporate, however, the drawback that they have always a free lane extending in the direction of the flow of fibers through the card clothing from the leading end to the trailing end of the card clothing. Due to this design individual fibers are not engaged to during the carding operation, i.e. they flow in an uncontrollable manner through the cleaning and parallelizing process, which obviously leads to the fact that neps and other contaminating matter present in the fibers being processed are not combed out.

The European patent application No. 80'10'3579 (publication No. 0041076) published on Dec. 9, 1981 discloses a card clothing in which at least two teeth formed by the card wires trailing each other in direction of fiber flow are located laterally displaced relative to each other seen in fiber flow by a distance which is not larger than the wire gauge of the card wire such that the card clothing has no free lanes. Mentioned European patent application discloses a card clothing which prevents the forming of lanes by means of a suitable wire setting pattern. In utilizing such stitch pattern it has been found that indeed a higher or better, respectively, removal of contaminations is arrived at during the carding operation and that, furthermore, a substantially increased degree of parallelism can be arrived at.

This has now led to the situation, that at the side of entry of the fibers into the card clothing on the fillet, i.e. at the leading end of each fillet, a damming effect of the fibers to be processed was produced. This damming effect causes now that the respective trailing teeth of the card clothing will not be utilized optimally, i.e. do not satisfactorily fulfill the object of separating or removing, respectively, contaminants and this damming effect has a detrimental influence on the carding process. The higher the throughput capacity of the carding machine is the stronger this damming effect will appear.

SUMMARY OF THE INVENTION

Hence, it is a general object of the present invention to provide an improved card clothing for carding machines which comprises no free lanes, yet obviates a damming effect of fibers at the leading end of the card clothing.

Another object of this invention is to provide an improved card clothing for carding machines, in which at least the first tips of the card wires of in direction of fiber flow trailing rows of teeth are located at least in groups in a decreasing measure seen in direction of fiber flow laterally displaced relative to the first tips of the card wires of in direction of fiber flow leading rows of teeth.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
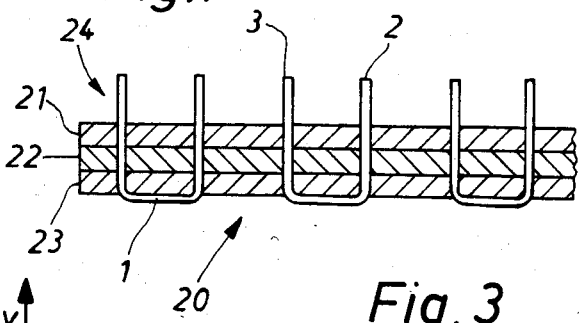
FIG. 1 is a schematically drawn cross section through a card fillet including teeth set therein.

Describing now the drawings, FIG. 1 illustrates schematically a cross section through a card fillet having card wires in shape of hooks forming the teeth 24, which teeth 24 are set into the card fillet 20. Generally, the card fillet 20 is a laminate of various kinds of materials, such as, for instance, of woven materials and plastic materials. The card fillet 20 shown for purposes of explanation only is built up by three layers 21, 22, 23 which are bonded to each other by means of an adhesive. The teeth 1, i.e. mentioned hooks, produced of wire are set into the card fillet 20. Such as illustrated in FIG. 1 and specifically clearly illustrated in FIG. 2 a respective tooth 24 comprises a tooth base section 1, two points 25 and two tooth tips 2, 3. For sake of illustration a distinction is made in the following description between a respective first tip 2 and a respective second tip 3 of the teeth referred to.

Figure 3:
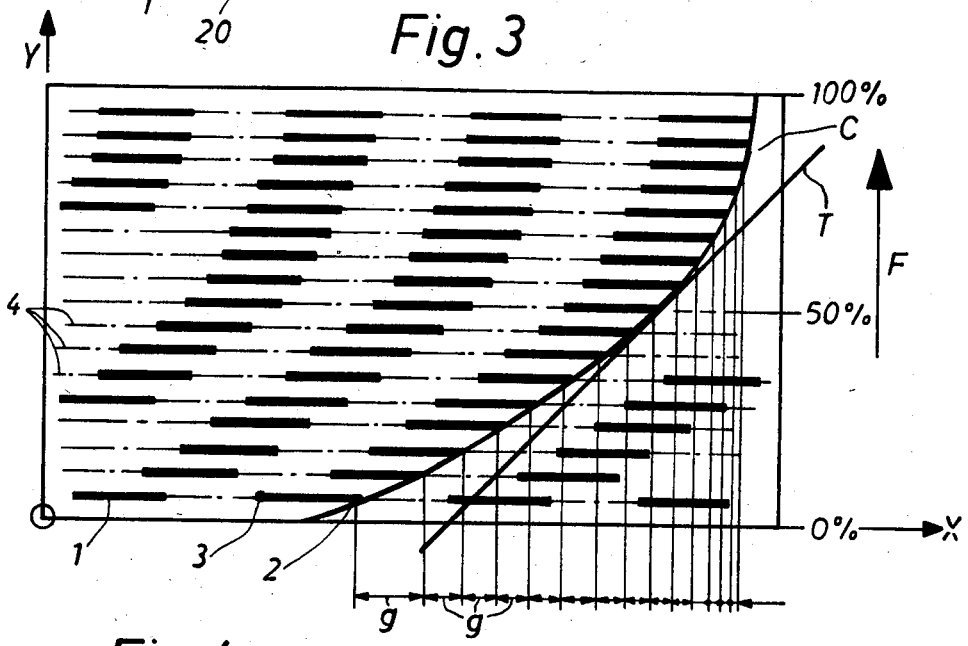
FIG. 3 is an illustration of a card fillet designed in accordance with DIN 64 108 of a first preferred embodiment of the invention.

In FIG. 3 a first preferred embodiment of the card clothing according to the invention is illustrated in accordance with the practice set forth in DIN 64 108. This figure is a view of the rear surface of the card fillet;

accordingly only the base sections 1 of the teeth are viewable.

Figure 4:
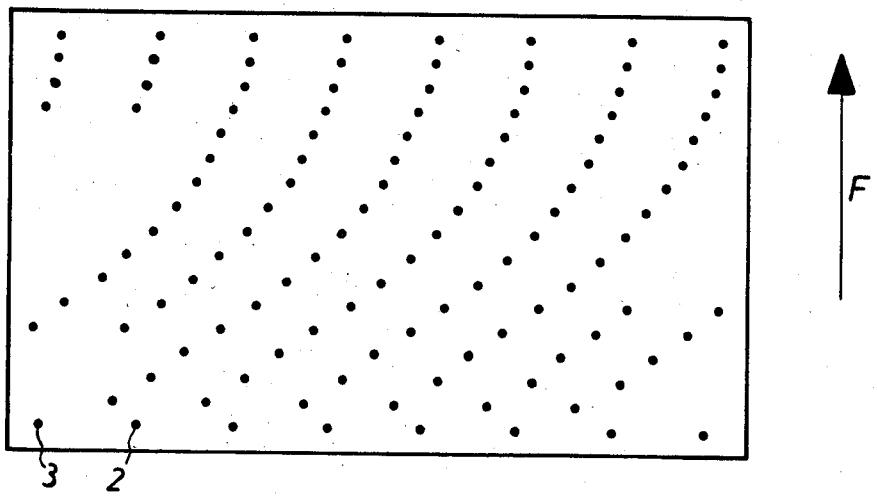
FIG. 4 shows the distribution or pattern, respectively, of the tips of the teeth of the embodiment illustrated in FIG. 1.

FIG. 4 illustrates a view of the front surface of the card fillet. This illustration differs slightly from the corresponding illustration of DIN 64 108 due to reasons of clarity in that merely the tips 2, 3 of the teeth and not their points have been drawn. The direction of fiber flow through the card fillet is identified by F. The tips of the respective teeth located at the respective right end of a base section 1 relative to the direction of fiber flow F are identified by reference numeral 2 and the tips located to the left relatively thereto are identified by reference numeral 3. The rows of teeth are identified generally by reference numeral 4 such as indicated at the left-hand side of FIG. 3. It can be said that the stitch pattern illustrated in FIG. 3 has proceeded from or has been developed from a so-called diagonal stitch pattern. As generally known, the tips 2, 3 of the teeth of the diagonal stitch pattern define a straight line extending obliquely, i.e. at an angle, relative to the direction of fiber flow F. In contrast thereto now, respective tips 2, 3 of the teeth trailing or following, respectively, each other relative to the direction of fiber flow F and located in accordance with the embodiment illustrated in FIG. 3 define a curve. The tips 2, 3 of the teeth of the card wires of rows 4 following or trailing, respectively, each other seen in direction of fiber flow F are located in a decreasing measure displaced relatively to each other and the measure of the displacement decreases from row to row seen in direction of fiber flow F. The width of the lanes determined by mentioned displacement or offset set pattern is identified generally by the letter g. As example, in FIG. 1 specifically those widths of the lanes g are illustrated which are defined by first tips 2 trailing each other relative to the direction of fiber flow F and are displaced relative to each other in accordance with the principles of the present invention. It can be seen clearly that this width of the lanes g decreases from row to row proceeding in direction F.

When viewing schematically the tips 2 of the teeth of FIG. 1, all having the same length of the base sections 1 mentioned tips 2 of the teeth define a curve C. This curve C may now be plotted in a coordinate system x; y, in which coordinate system x extends in direction of the width of the carding machine and y extends in the direction of the width of the flat of the card clothing, whereby the zero point 0 is located at the lower left edge of the flat. The gradient or inclination, respectively, of this curve C increases along the curve. This gradient can follow various mathematical equations in the illustrated coordinate system.

According to one embodiment this curve C follows the equation $$y=x^a, \text{ and } (o<a<\infty).$$

a must not necessarily be an integral number. Conclusively, the width of the lane g will decrease continuously at an increasing y and strives towards zero. Obviously, values which lead to $g \leqq 0$ are senseless, because the width of the lane g can be a positive number only.

According to a further embodiment this curve C follows the following equation $$y=Aa^{kx}.$$

A and k are constant values. If these values are taken $=1$, this equation reads $$y=a^x.$$

a is a variable and accordingly can also equal the mathematical value e (basis of the natural logarithms). Such curves do not extend asymptotically. Because, however, the points of the card wires have a finite value of the diameter also this embodiment incorporates the rule, that at a calculable value of y the width of the lane g will arrive at the value $g=0$.

A further embodiment of the setting of the card wires is illustrated in FIGS. 3 and 4 and is confined to a specific section or part, respectively, of the curve C. The width of the flat amounts to a measure given by a finite number, i.e. y[cm]. Accordingly, the specific part of the curve C which is utilized may be a part having a small incline or also a part of the curve C having a high incline. The edge of the flat which is the leading edge based on the direction of fiber flow therethrough is identified by 0% and the trailing edge by 100% of the width of the flat, the halfway area is identified by 50% such as illustrated in FIG. 3.

In this further preferred embodiment the part of the curve C extending between 0% and 50% width of the flat follows the equation $\Delta y<\Delta x$. At the area of 50% of the width of the flat this equation amounts to $\Delta y=\Delta x$. At this location the tangent T to the curve C has an angle of incline of 45°, i.e. a tangent of 1. Finally, the part of the curve C extending between 50% and 100% of the width of the flat obeys the equation $\Delta y>\Delta x$. Accordingly, the distance between the center lines of the base sections of the card wires of rows 4 of teeth following each other relative to the direction of fiber flow F is in the area of the forward (leading) half of the flat smaller than the measure of the displacement, in the area of half of the width of the flat mentioned distance equals the measure of the displacement and in the area of the rear (trailing) half of the flat it is larger than the measure of the displacement.

Above, some embodiments of the extent of the curve C have been explained. Following further embodiments will be described, in which the tips of the teeth define curves. It shall be clearly noted here, that these curves extend also in accordance with the above described various embodiments and accordingly the various combinations of the embodiments of the extent of the curves C will not be discussed again.

Figure 5:
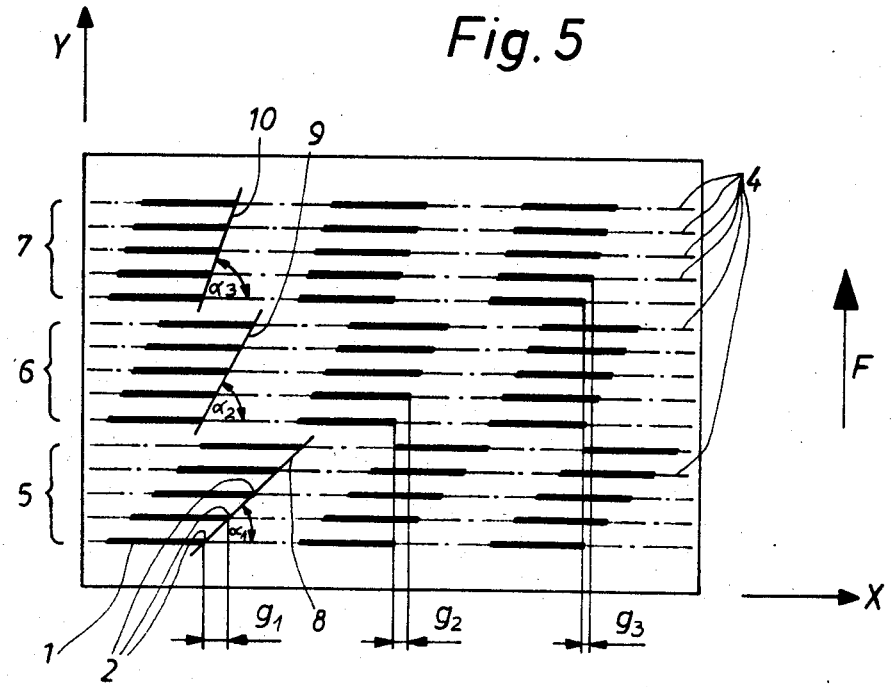
FIG. 5 is an illustration of a card fillet in accordance with DIN 64 108 of a preferred embodiment of the invention resembling a rib stitch pattern.

FIG. 5 illustrates an embodiment, in which the first and the second tips of the card wires of in direction of fiber flow F trailing rows 4 are located in groups in a decreasing measure laterally displaced relative to the first and second tips of the card wires of in the direction of fiber flow F leading rows 4.

This embodiment is based on the rib stitch, in this illustration as example on the 5-rib stitch. The figure illustrates three groups 5, 6 and 7 located trailing each other relative to the direction of fiber flow F. Group 5 comprises a width of lane $g_1$ corresponding to its displacement, group 6 has a width of lane $g_2$ corresponding to its specific displacement and group 7 has a width of lane $g_3$ corresponding in turn to its specific displacement. The tips 2 of the teeth of the leading group 5 define, for instance, a straight line 8, the tips 2 of group 6 a straight line 9 and the tips of group 7 a straight line 10. All base sections 1 have the same length and for the sake of clarity only those straight lines are drawn which are defined by the respective second tips 2 at the right hand side of the hooks. In the coordinate system x, y the straight line 9 has a larger incline than the straight line 8, and the straight line 10 in turn has a large incline than the straight line 9. Accordingly, when viewed in the direction of fiber flow F group-wise smaller widths of lanes $g_1$, $g_2$, $g_3$, . . . are formed. If the incline of the respective straight lines 8, 9, 10 are based on the angle of incline $\alpha$ in mentioned coordinate system x; y, the angle $\alpha_1$ of line 8 amounts to $x^o$, of $\alpha_2$ of line 9: $(x+y)^o$, $\alpha_3$ of line 10: $(x+2y)^o$, . . . etc. When viewed in the direction y, a finite number of groups 5, 6, 7 . . . is present. Accordingly, for the last of the groups n seen in direction of fiber flow F the following equation is applicable: $\alpha_n=(x+ny)^o<90°$. The width of the lane g moves, therefore, asymptotically towards zero, i.e. the following equation is applicable: $tg\alpha_n<\infty$.

Figure 2:
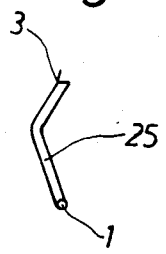
FIG. 2 is a side view of a tooth illustrated in FIG. 1.
Figure 6:
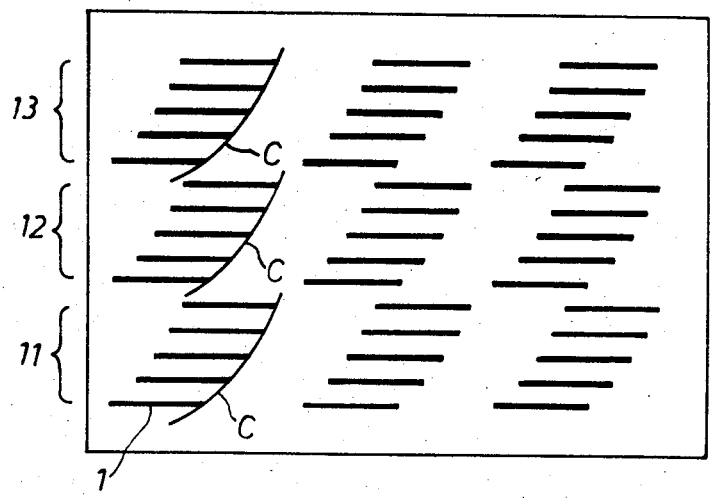
FIG. 6 is an illustration of a third preferred embodiment having a repeating repeat.

The embodiment illustrated in FIG. 6 equals the embodiment of FIG. 3 insofar that one can say it is a rib stitch, however the displacement within any respective group 11, 12, 13 . . . is according to the rules or embodiments, respectively, of FIGS. 1 and 2. For sake of clarity the respective curve C is designed in FIG. 4. The individual groups 11, 12, 13 . . . incorporate each the same mathematical principle of the displacement, i.e. line C.

Figure 7:
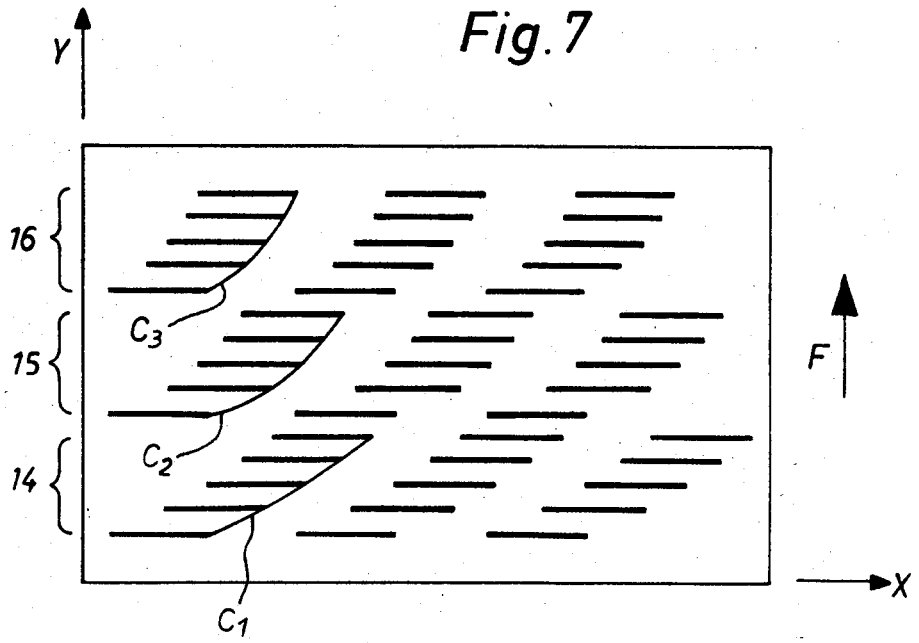
FIG. 7 illustrates a fourth preferred embodiment of the invention.

The embodiment of FIG. 7 deviates from the embodiment according to FIG. 6 in that similar to the embodiment of FIG. 5 the individual groups 14, 15, 16, . . . have not the same pattern, i.e. the measure of the decrease of the displacement of the groups 14, 15, 16, . . . viewed in direction of fiber flow F increases. All curves C of FIG. 6 have the same mathematical principle. However, in FIG. 7 the increase of the incline of curve $C_2$ is larger than that of curve $C_1$, and the increase of the incline of curve $C_3$ is in turn larger than that of curve $C_2$, . . For instance, the curve $C_1$ can follow the rule $x=y^2$, the curve $C_2$ can follow the rule $x=y^3$, and the curve $C_3$ can follow the rule $x=y^4$, or in case of exponential curves the following can be valid for $C_1$: $y=Ae^{2x}$, for $C_2$: $y=Ae^{3x}$, and for $C_3$: $y=Ae^{4x}$.

Figure 8:
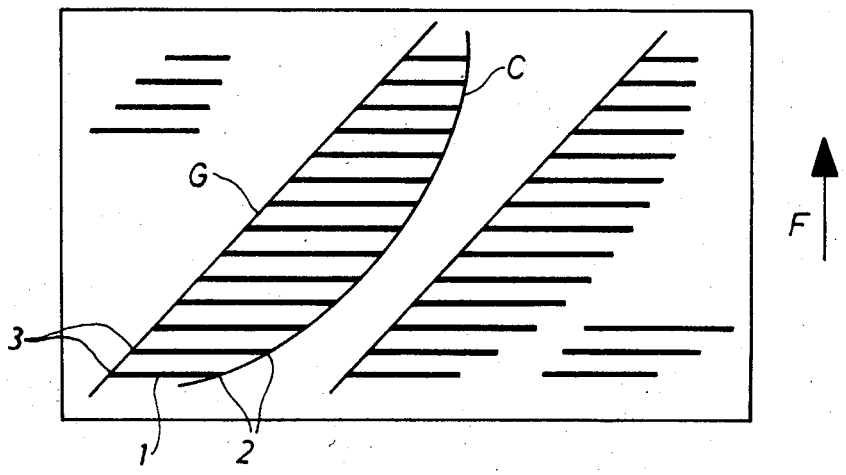
FIG. 8 illustrates a fifth preferred embodiment of hooks or teeth, respectively, having base sections of varying length.

In FIG. 8 an embodiment is illustrated, in which merely the displacement of the first tips 2 of the teeth and accordingly the width of lanes g defined from these tips 2 decrease in the direction of fiber flow F. These first tips 2 define again a curve C, which comprises one of the above mentioned rules. The second tips 3 define, however, a diagonally extending straight line G. Accordingly, this card clothing incorporates base sections 1 of various lengths.

The embodiment illustrated in FIG. 8 may also be set in further variations, also group-wise similar to the embodiments of, for instance, FIGS. 6 and 7.

The decreasing displacement which gets decreasingly smaller in the direction of fiber flow F and accordingly the width of the lanes of all above described embodiments lead to a funnel-like effect during the carding.

In the leading area of the flat initially only coarser contaminants are removed and accordingly trailing areas of the flat will not be subject to damming effects due to, for instance, blocking situations.

Furthermore, the shape and the position of the fibers will be changed during the parallelizing process progressively and to an increasing extent, the fibers are handled more gently and damming effects at the inflow section of the flat can be eliminated.

While there are shown and illustrated present preferred embodiments of the invention, it is to be distinctly understood that the invention is not limited thereto, but may be otherwise variously embodied and practiced within the scope of the following claims.

I claim:

1. An improved card clothing for carding machines, including a plurality of card wire teeth arranged in rows including leading rows located at a leading end of said card clothing and trailing rows located at a trailing end of said card clothing with respect to direction of fiber flow and set into a card fillet, which wire teeth are shaped to have a base section, a first point including a first tip projecting from one end of said base section and a second point including a second tip projecting from the opposite end of said base section, in which at least the first tips of the card wires of said trailing rows are laterally displaced at least in groups in decreasing measure seen in the direction of fiber flow relative to the first tips of the card wires of said leading rows with a progressive decrease in lateral displacement from said leading end to said trailing end.

2. The improved card clothing of claim 1, wherein the extent of the decrease of the displacement progresses asymptotically towards zero.

3. The improved card clothing of claim 1, wherein the extent of the decrease of the displacement decreases exponentially.

4. The improved card clothing of claim 1, in which the distance between the centerlines of said base sections of rows following each other in direction of fiber flow in the area between the leading end and halfway area of the flat is less than the measure of the displacement, in the area of halfway between the leading and trailing ends of the flat the same as the measure of the displacement, and in the area between the trailing end and halfway area of the flat larger than the measure of the displacement.

5. The improved card clothing of claim 1, in which the first and the second tips of the card wires of trailing rows are laterally displaced at least in groups in decreasing measure seen in the direction of fiber flow relative to the first and second tips of the card wires of leading rows with a progressive decrease in lateral displacement from said leading end to said trailing end.

6. The improved card clothing of claim 5, which is set in groups in an n-rib stitch, in which the measure of displacement of the row of teeth within a respective n-rib stitch group is the same, and in which the displacement with respect to direction of fiber flow of trailing n-rib stitch groups is less than the displacement of leading n-rib stitch groups.

7. The improved card clothing of claim 5 which is set in groups in an n-rib stitch, in which all groups have the same stitch pattern and the measure of displacement within each group decreases in the direction of fiber flow.

8. The improved card clothing of claim 5 which is set in groups in an n-rib stitch, in which the measure of the displacement within each n-rib stitch group decreases in direction of fiber flow, and in which the measure of the decrease of the displacement with respect to direction of fiber flow of trailing n-rib stitch groups is larger than the measure of the decrease of the displacement of leading n-rib stitch groups.

9. The improved card clothing of claim 1, in which the first tips of the card wires of trailing rows are located in a decreasing measure seen in direction of fiber flow laterally displaced relative to the first tips of the card wires of leading rows, and in which the second tips of the card wires of trailing rows are located in an invariable measure relative to the second tips of the card wires of leading rows, with respect to direction of fiber flow.

* * * * *